US008418804B1

(12) United States Patent
Hawwa

(10) Patent No.: US 8,418,804 B1
(45) Date of Patent: Apr. 16, 2013

(54) MULTIPLE HELMHOLTZ RESONATORS

(75) Inventor: Muhammad A. Hawwa, Dharan (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/332,067

(22) Filed: Dec. 20, 2011

(51) Int. Cl.
*F01N 1/02* (2006.01)

(52) U.S. Cl.
USPC ..... 181/224; 181/250; 381/353

(58) Field of Classification Search ..... 181/197, 181/219, 224, 225, 226, 232, 241, 271, 277; 381/353, 71.5, 73.1
See application file for complete search history.

(56) References Cited

U.S. PATENT DOCUMENTS

| | | | | |
|---|---|---|---|---|
| 3,253,676 | A * | 5/1966 | Bottum | 181/241 |
| 4,874,062 | A | 10/1989 | Yanagida et al. | |
| 5,283,398 | A * | 2/1994 | Kotera et al. | 181/224 |
| 5,771,851 | A | 6/1998 | McLean | |
| 5,930,371 | A | 7/1999 | Cheng et al. | |
| 6,069,840 | A | 5/2000 | Griffin et al. | |
| 6,422,192 | B1 | 7/2002 | Bloomer | |
| 6,508,331 | B1 | 1/2003 | Stuart | |
| 6,698,390 | B1 | 3/2004 | Kostun et al. | |
| 6,732,510 | B2 | 5/2004 | Ciray | |
| 6,758,304 | B1 | 7/2004 | McLean | |
| 6,792,907 | B1 * | 9/2004 | Kostun et al. | 123/184.57 |
| 7,055,484 | B2 | 6/2006 | Marks et al. | |
| 7,117,974 | B2 | 10/2006 | Moenssen et al. | |
| 7,334,663 | B2 | 2/2008 | Nakayama et al. | |
| 7,364,012 | B2 | 4/2008 | White, Jr. | |
| 7,584,821 | B2 * | 9/2009 | Prior et al. | 181/241 |
| 7,800,895 | B2 | 9/2010 | Inoue et al. | |
| 7,870,930 | B2 | 1/2011 | Bogard | |
| 2005/0011699 | A1 * | 1/2005 | Horiko | 181/250 |
| 2005/0161280 | A1 * | 7/2005 | Furuya | 181/225 |
| 2006/0086564 | A1 | 4/2006 | Kostun et al. | |
| 2008/0066999 | A1 * | 3/2008 | Kostun et al. | 181/250 |

FOREIGN PATENT DOCUMENTS

JP 2006283625 A 10/2006

OTHER PUBLICATIONS

M.B. Xu et al., "Dual Helmholtz resonator", *Applied Acoustics*, vol. 71, Issue 9, Sep. 2010, pp. 822-829.

* cited by examiner

*Primary Examiner* — Jeremy Luks
(74) *Attorney, Agent, or Firm* — Richard C. Litman

(57) ABSTRACT

Multiple Helmholtz resonators are combined serially and dynamically to mitigate and/or overcome acoustic noise filtering problems. One Helmholtz resonator is attached to a duct having an acoustic flow path channel containing undesired acoustic signals (noise) and is considered to be an immovable Helmholtz resonator with respect to that flow channel, while at least one movable Helmholtz resonator is movably and acoustically coupled to the immovable Helmholtz resonator. The immovable and movable Helmholtz resonators are acoustically coupled together to adjustably filter two resonant frequencies in the flow path channel with a feedback control system that adjusts the position of the movable Helmholtz resonator in response to the differences in pre-filtered noise versus filtered noise.

10 Claims, 5 Drawing Sheets

MULTIPLE HELMHOLTZ RESONATORS

BACKGROUND OF THE INVENTION

1. Field of the Invention

The present invention relates to devices for dampening noise, and particularly to multiple Helmholtz resonators that are acoustically coupled together to quickly and adjustably filter out more than one acoustic frequency.

2. Description of the Related Art

The Helmholtz resonator was first designed by Hermann von Helmholtz in the 1850s. The Helmholtz resonator has a cavity communicating with a main duct through a neck and is used to effectively attenuate narrow-band, low frequency noise. Narrow-band noise in the form of tonal noise is quite common in the case of rotating machinery, and in particular, in applications involving engine breathing systems. For example, an engine exhaust flow path may pass by an opening or throat of a Helmholtz resonator. Beyond the opening is a cavity in the Helmholtz resonator. The dimensions of the throat and cavity, in conjunction with the makeup of the gases involved, will determine the precise resonant frequency absorbed by the Helmholtz resonator.

The Helmholtz resonator is often looked at as an acoustic wave equivalent of a spring-mass system, where the spring represents the cavity and the mass represents the neck. Thus, the resonator's frequency and the transmission loss can be readily determined.

While Helmholtz resonators have been used to dampen specific frequencies, and multiple Helmholtz resonators can dampen a corresponding number of frequencies, it is often impractical to employ multiple, separate Helmholtz resonators. Even where the use of multiple Helmholtz resonators is not a problem, their use is ineffective in situations where the ideal frequencies to be filtered are not sufficiently static, especially where those frequencies change quickly. Thus, multiple Helmholtz resonators solving the aforementioned problems are desired.

SUMMARY OF THE INVENTION

The multiple Helmholtz resonators are combined serially and dynamically to mitigate and/or overcome the aforementioned problems. One Helmholtz resonator is attached to the flow path channel and is considered to be an immovable Helmholtz resonator with respect to that flow channel, while at least one movable Helmholtz resonator is movably coupled adjacent the immovable Helmholtz resonator. The immovable and movable Helmholtz resonators are acoustically coupled together so that they can adjustably filter two frequencies in the flow path channel.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The multiple Helmholtz resonators adaptively and adjustably filter more than one acoustic frequency, often including more than one acoustic resonant frequency.

Figure 1:
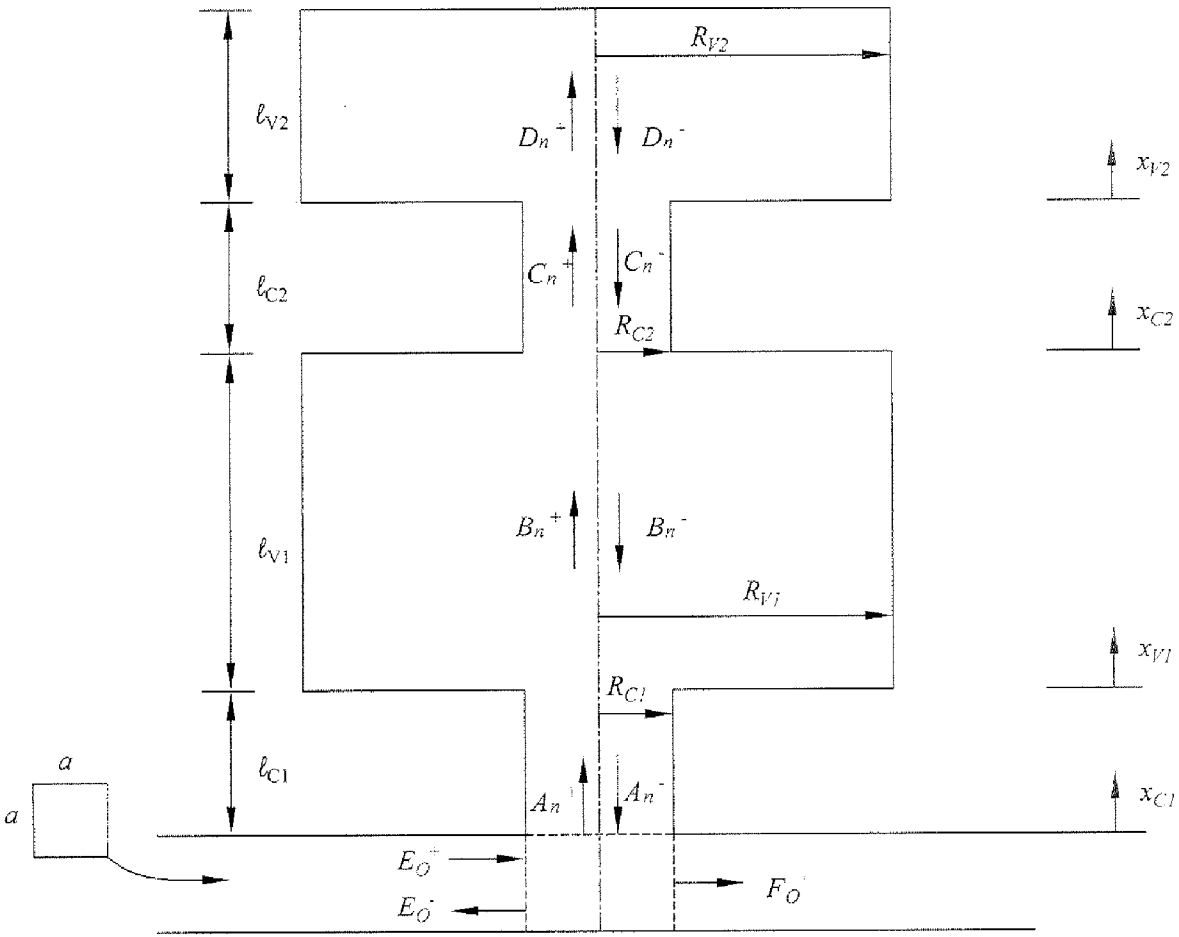
FIG. 1 is a diagram of multiple Helmholtz resonators, illustrating a model identifying variables associated with a dual resonant frequencies formula.

FIG. 1 shows a diagram of multiple Helmholtz resonators, illustrating an analytical model associated with a dual resonant frequencies formula and diagrammatically identifying variables used in the formula. The model is used in combination with the following formula to determine the dual resonant acoustic properties of the multiple Helmholtz resonators that employ two Helmholtz resonators arranged serially:

$$f_{1,2} = \frac{c_o}{2\sqrt{2}\pi}\sqrt{\left(\frac{A_{C1}}{l'_{C1}V_1} + \frac{A_{C2}}{l'_{C2}V_1} + \frac{A_{C2}}{l'_{C2}V_2}\right) \pm \sqrt{\left(\frac{A_{C1}}{l'_{C1}V_1} + \frac{A_{C2}}{l'_{C2}V_1} + \frac{A_{C2}}{l'_{C2}V_2}\right)^2 - 4\left(\frac{A_{C1}}{l'_{C1}V_1}\frac{A_{C2}}{l'_{C2}V_2}\right)}}$$

where the formula and FIG. 1 are shown in "Dual Helmholtz resonator," by M. B. Xu, A. Selamet and H. Kim, as published in *Applied Acoustics*, Vol. 71, Issue 9 (September 2010) pp. 822-829. The variables in the formula are as shown in FIG. 1 and described in the Xu et al. articles, which is incorporated herein by reference.

Figure 2:
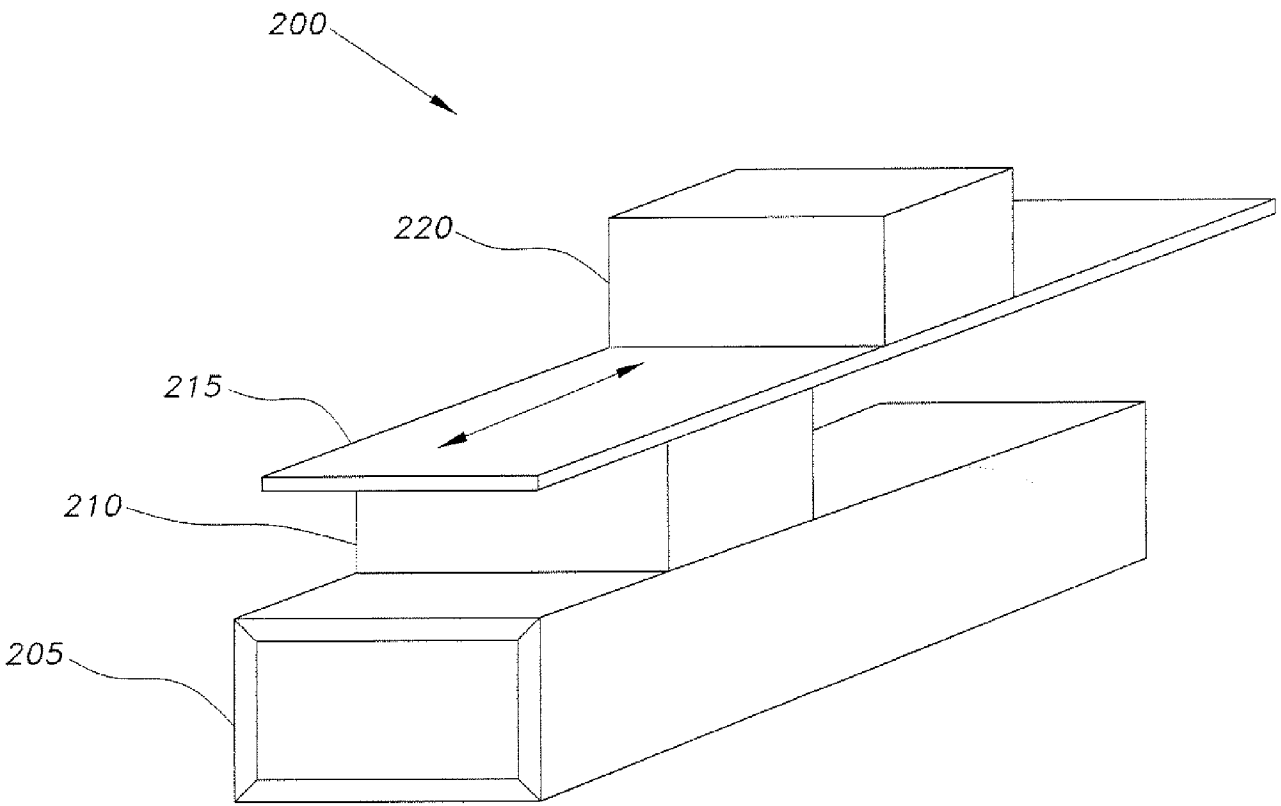
FIG. 2 is a perspective view of multiple Helmholtz resonators according to the present invention.

FIG. 2 shows a perspective view of multiple Helmholtz resonators 200 acoustically coupled to a duct 205 that carries the sounds to be filtered through a gas medium. The duct 205 acts as an acoustic waveguide for transporting undesired sounds for filtering. Although the multiple Helmholtz resonators are described with respect to gaseous media, any media capable of carrying sound could be used, including liquid and solid media. The duct 205 is open to an immovable Helmholtz resonator 210 through a neck aperture that functions as the neck of the immovable Helmholtz resonator 210. The immovable Helmholtz resonator 210 is not required to be completely immovable, and its designated name is used to bring into contrast one or more other Helmholtz resonators that move by design. The immovable Helmholtz resonator 210 is essentially fixed above the neck aperture in the duct 205. For example, the immovable Helmholtz resonator 210 may be welded to the duct 205. The immovable Helmholtz resonator 210 also has an upper aperture, i.e., it does not have a top and can be considered topless.

Shown above the immovable Helmholtz resonator 210 in FIG. 2 is a movable laminate plate 215. The movable laminate is a rectangular plate in shape and moves along the same longitudinal axis as the duct 205, as indicated by the arrows. The movable laminate plate 215 has a neck aperture in it for allowing sounds to pass through the plate. In the case of the movable laminate plate 215, sounds pass through the neck aperture to a movable Helmholtz resonator 220. The movable Helmholtz resonator 220 is attached to the movable laminate plate 215 so it will move with respect to the immovable Helmholtz resonator 210 as the position of the movable laminate plate 215 is varied.

The primary purpose of the movable laminate plate 215 is to movably position the neck aperture of the movable Helmholtz resonator 220 into alignment above the upper (topless) aperture of the immovable Helmholtz resonator 210 to bring the Helmholtz resonators 210, 220 into various phases of acoustic alignment. A lower surface of the movable laminate can also completely cover the upper aperture of the immovable Helmholtz cavity to cause the immovable Helmholtz resonator to function as a single Helmholtz resonator, if desired. If the movable laminate slides further, the movable Helmholtz resonator 220 can be positioned directly above the immovable Helmholtz resonator 210. In this position, the Helmholtz resonators 210, 220 can be considered to form a "neck-cavity-neck-cavity" acoustic filtering system having two Helmholtz resonators 210, 220 connected in series. This arrangement of Helmholtz resonators 210, 220 is capable of attenuating two narrow-band resonant frequency noises, as opposed to a single narrow-band resonant frequency for a single Helmholtz resonator. The formula and model for this is shown above with regard to FIG. 1.

Alternatively, if desired, the immovable Helmholtz resonator 210 and a plurality (n) of movable resonators 220 can be acoustically coupled to form a stack or series of Helmholtz resonators 210, 220 to attenuate (n) narrow-band noises. Partial alignment of Helmholtz resonators may also be desirable in some acoustic filtering cases.

Figure 3:
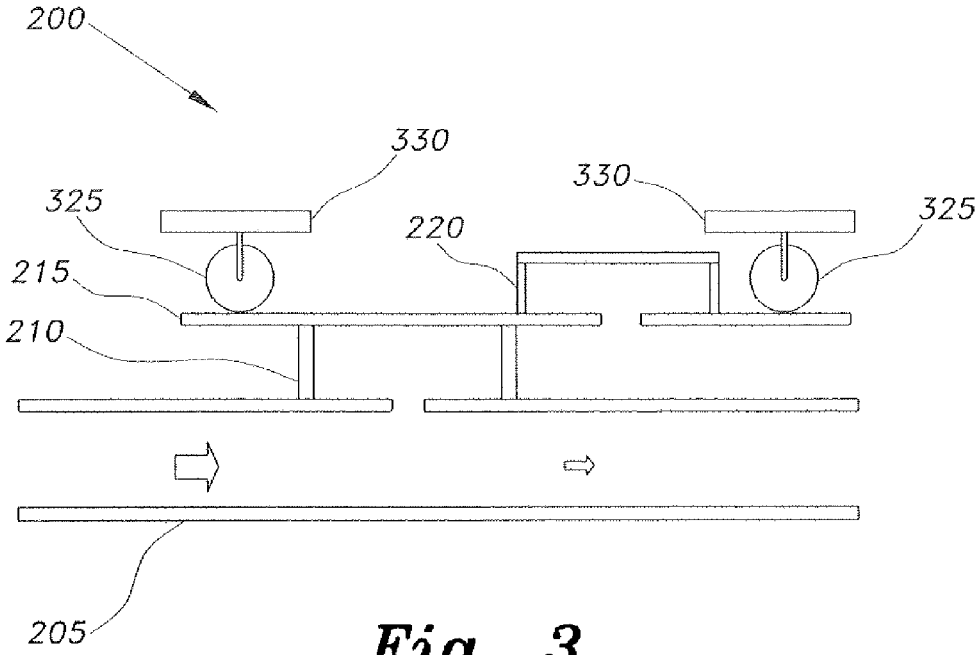
FIG. 3 is a diagrammatic side view in section of multiple Helmholtz resonators of the present invention, shown in a first position in which the immovable Helmholtz resonator provides a single Helmholtz resonator operably connected to a duct.

FIG. 3 shows a side view in section of the multiple Helmholtz resonators 200 in a first position. Sound, i.e., pressure waves, is shown moving from left to right in the duct 205. The volume of the sound is indicated by the large arrow inside the duct 205 on the left and it is reduced in volume by the multiple Helmholtz resonators 200, as indicated by the smaller arrow inside the duct 205 on the right. The neck aperture in the duct 205 leading to the immovable Helmholtz resonator 210 can be easily seen here. The multiple Helmholtz resonators 200 use motorized wheels 325, each connected to an anchor 330, to adjust the position of the movable laminate plate 215 and the movable Helmholtz resonator 220 relative to the duct 205 and the immovable Helmholtz resonator 210. The motorized wheels 325 move in response to a control signal. The multiple Helmholtz resonators 200 are not restricted to motorized wheels 325. Rollers, linear motors, linear actuators, and other apparatus for moving the movable laminate are envisioned and compatible with the multiple Helmholtz resonators 200.

The upper aperture (topless portion) in the immovable Helmholtz resonator 210 is completely covered by the movable laminate plate 215 in FIG. 3. The movable laminate plate 215 has been positioned so that the neck aperture in the movable laminate plate 215 leading to the movable Helmholtz resonator 220 does not overlap at all with the upper aperture of the immovable Helmholtz resonator 210. Thus, FIG. 3 illustrates the immovable Helmholtz resonator 210 acting as single Helmholtz resonator, acoustically separated from the movable Helmholtz resonator 220. This situation is modeled in FIGS. 5A and 5B, as described herein.

Figure 4:
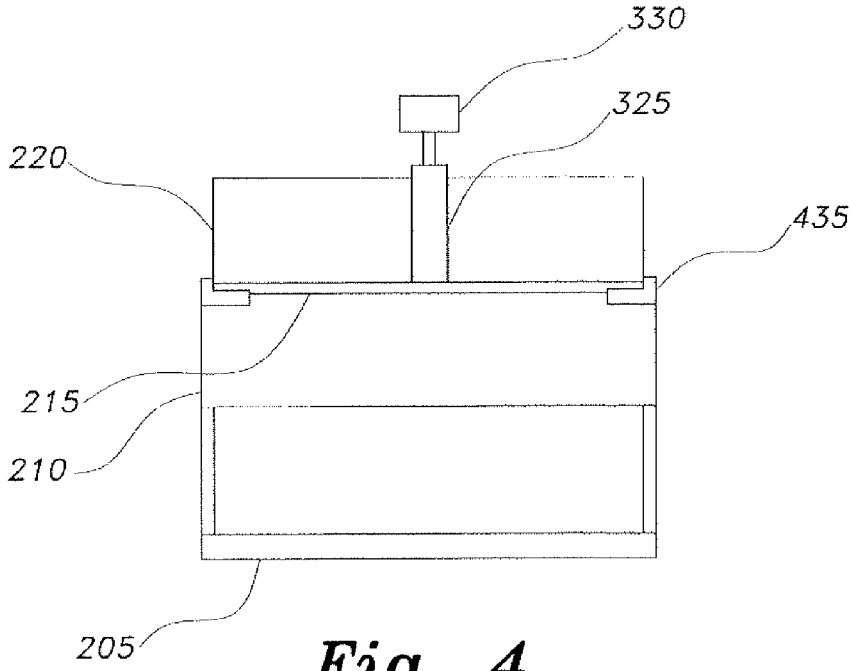
FIG. 4 is a diagrammatic front view in section of multiple Helmholtz resonators of the present invention.

FIG. 4 shows a front view in section of the multiple Helmholtz resonators 200. The motorized wheels 325 are shown in contract with the movable laminate plate 215 in order to position the movable laminate plate 215, as described herein. The movable laminate plate 215 is in contact with an L-channel 435, as shown. The L-channel 435 is shaped like the letter "L" and presents a low-friction surface to the movable laminate plate 215 to reduce the load experienced by the motorized wheels 325. The movable Helmholtz resonator 220 and movable laminate plate 215 are moved by the motorized wheels 325 relative to the immovable Helmholtz resonator 210 and duet 205, as described herein.

Figure 5A:
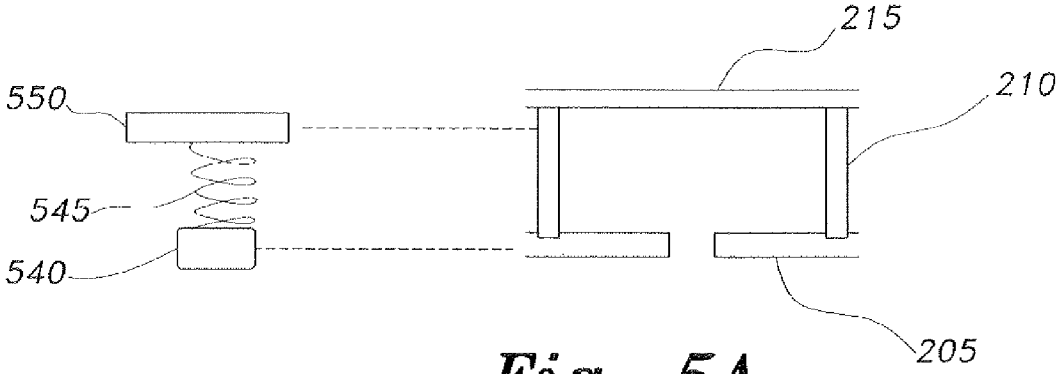
FIG. 5A is a diagrammatic single Helmholtz resonator of the present invention and a corresponding mass-spring physical model.

FIG. 5A shows a single Helmholtz resonator and a corresponding mass-spring physical model. A single Helmholtz resonator represents the immovable Helmholtz resonator 210 being completely covered by the movable laminate plate 215 (as shown in FIG. 3). The neck aperture in the duct 205 is modeled as a mass 540. The immovable Helmholtz resonator 210 has dimensions giving rise to a volume comparable to a spring 545. The spring 545 is attached to both the mass 540 and a relatively immovable object 550 for modeling purposes and to model the frequency properties of the immovable Helmholtz resonator 210, as shown. The formula for the resonant frequency of a single Helmholtz resonator is:

$$f_r = \frac{c_o}{2\pi}\sqrt{\left(\frac{A_{C1}}{l'_{C1}V_1}\right)}$$

where $A_{C1}$ is the area of the neck, $V_1$ is the volume of the resonator, $C_o$ is the velocity of sound in air, and $l'_{C1}$ is the length of the neck.

Figure 5B:
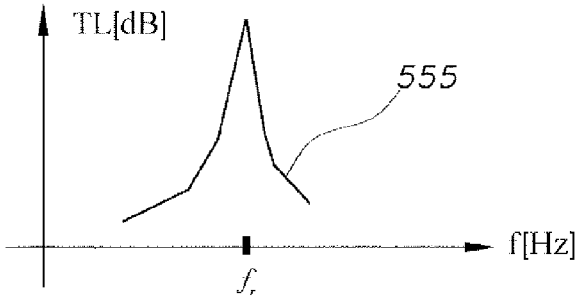
FIG. 5B is a graph of transmission loss (TL) in decibels (dB) versus frequency in Hertz (Hz) corresponding to FIG. 5A.

FIG. 5B is a graph of transmission loss (TL) in decibels (dB) versus frequency in Hertz (Hz) corresponding to FIG. 5A. As shown in FIG. 5A, a frequency response 555 associated with a single Helmholtz resonator has a resonant frequency $f_r$ where the attenuation of sound is greatest. Importantly, the single Helmholtz resonator modeled in FIG. 5A corresponds to a single resonant frequency $f_r$ as shown in FIG. 5B.

Figure 6:
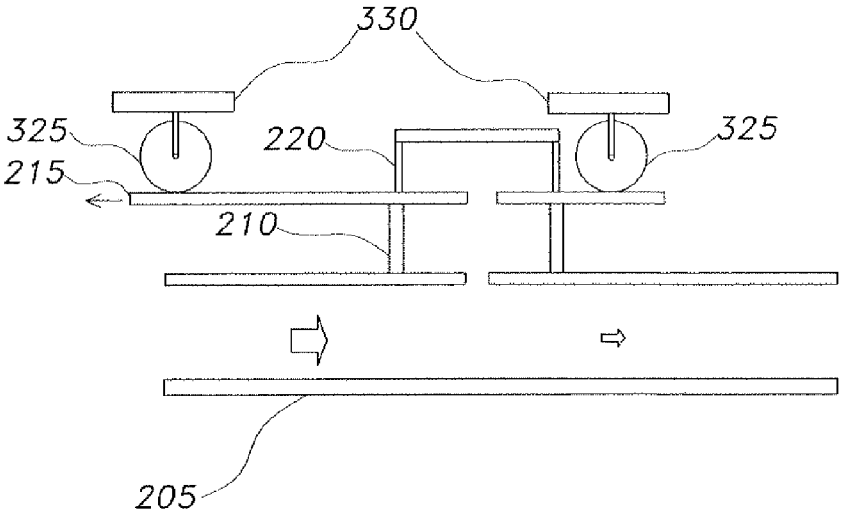
FIG. 6 is side view in section of the multiple Helmholtz resonators of FIG. 3, shown in a second position in which the movable Helmholtz resonator is aligned with the immovable Helmholtz resonator to provide two Helmholtz resonators connected in series operably connected to the duct.

FIG. 6A shows a side view in section of the multiple Helmholtz resonators 200 in a second position. FIG. 6A corresponds to FIG. 3, except that the motorized wheels 325 have repositioned the movable laminate plate 215 so that the movable Helmholtz resonator 220 is positioned directly above the immovable Helmholtz resonator 210. In this arrangement the immovable Helmholtz resonator 210 is acoustically coupled to the movable Helmholtz resonator 220, thereby producing a combined frequency response, as described with regard to FIGS. 7A and 7B. In short, the arrangement shown in FIG. 6 enables two primary resonant frequencies to be filtered out of the noise in the duet 205. Additional resonant frequencies can be filtered with additional movable Helmholtz resonators stacked atop the movable Helmholtz resonator 220.

Figure 7A:
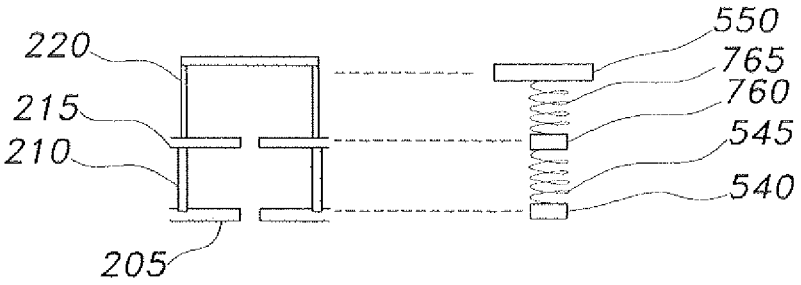
FIG. 7A is a schematic diagram showing aligned multiple Helmholtz resonators and a corresponding mass-spring physical model.

FIG. 7A shows aligned multiple Helmholtz resonators and a corresponding mass-spring physical model. The aligned multiple Helmholtz resonators correspond to the aligned multiple Helmholtz resonators 210, 220 shown in FIG. 6. As shown before in FIG. 5A, in FIG. 7A the neck aperture in the duet 205 is modeled as a mass 540. The immovable Helmholtz resonator 210 has dimensions giving rise to a volume comparable to a spring 545. However, the spring 545 is shown here attached to a mass 760 corresponding to the neck aperture in the movable laminate plate 215. The mass 760 is connected to a spring 765. The movable Helmholtz resonator 220 has dimensions giving rise to a volume comparable to the spring 765. The spring 765 is attached to the relatively immovable object 550 and the mass 760 to model the frequency properties of the combined immovable Helmholtz resonator 210 and movable Helmholtz resonator 220, as shown.

Figure 7B:
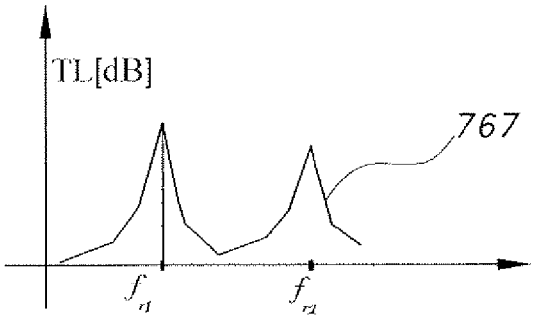
FIG. 7B is a graph of transmission loss (TL) in decibels (dB) versus frequency in Hertz (Hz) corresponding to FIG. 7A.

FIG. 7B is a graph of transmission loss (TL) in decibels (dB) versus frequency in Hertz (Hz) corresponding to FIG. 7A. As shown in FIG. 7A, a frequency response 767 associated with a dual Helmholtz resonator has a first resonant frequency $f_{r1}$ and a second resonant frequency $f_{r2}$ where the attenuation of sound is greatest. Importantly, the dual Helmholtz resonator modeled in FIG. 7A corresponds to dual resonant frequencies $f_{r1}$ and $f_{r2}$ as shown in FIG. 7B and acoustic filtering is improved as compared to the single Helmholtz resonator model in FIG. 5B.

Figure 8:
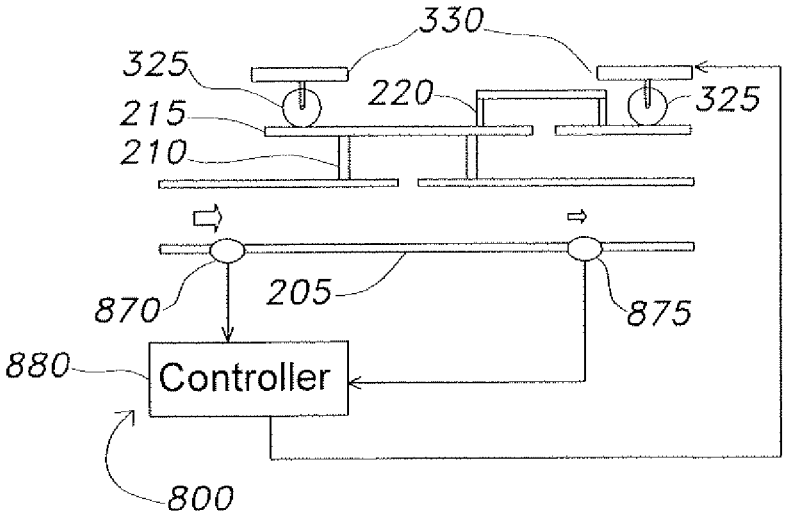
FIG. 8 is schematic diagram of a control system for adaptively damping acoustic noise using multiple Helmholtz resonators according to the present invention.

FIG. 8 is diagram of a control system for adaptively damping noise using multiple Helmholtz resonators of the present invention. The starting arrangement shown in FIG. 8 corresponds to that shown in FIG. 3, but is adjusted by a control system 800 to an arrangement such as shown in FIG. 6. Intermediate positions may also be desirable. The control system 800 uses an input microphone 870 to detect sound before filtering by the multiple Helmholtz resonators 200 and produces corresponding input signals. An error microphone 875 detects sound after filtering by the multiple Helmholtz resonators 200 and produces corresponding error signals. Signals from the input microphone 870 and error microphone 875 are transmitted to a controller 880 that includes a microprocessor. The controller 880 processes information from the microphones 870, 875 to produce and transmit control signals to the motorized wheels 325, which slide the movable laminate plate 215 in response to those signals. Adjustments in the positioning of the movable Helmholtz resonator 220 on the movable laminate plate 215 by the controller 880 enables the multiple Helmholtz resonators 200 to generate the desired transmission loss spectrum. The controller 880 uses a feedback mechanism to control the positioning of the movable Helmholtz resonator 220 by analyzing differences between input signals from the input microphone 870, representing pre-filtered noise, and error signals from the error microphone 875, representing filtered noise, to obtain the desired or best acoustic filtering.

It is to be understood that the present invention is not limited to the embodiments described above, but encompasses any and all embodiments within the scope of the following claims.

I claim:

1. Multiple Helmholtz resonators for filtering sound in a duct having a neck aperture, comprising:

an immovable Helmholtz resonator adapted for physically connection to the duct adjacent to the neck aperture and acoustically coupling to the sound in the duct through the neck aperture;

a movable laminate plate movably coupled to the immovable Helmholtz resonator and forming part of the immovable Helmholtz resonator, the movable laminate plate having a neck aperture;

a motorized wheel in contract with the movable laminate plate and moving in response to control signals;

a movable Helmholtz resonator mounted on the movable laminate plate adjacent to the neck aperture in the movable laminate plate and acoustically coupled to the immovable Helmholtz resonator, the plate being movable between a first position in which the movable Helmholtz resonator is out of alignment with the immovable Helmholtz resonator, whereby the immovable Helmholtz resonator functions as a single Helmholtz resonator dampening sound in the duct, and a second position in which the movable Helmholtz resonator is aligned with the immovable Helmholtz resonator, whereby the movable and immovable Helmholtz resonators function as two Helmholtz resonators in series dampening sound in the duct;

an input microphone adapted for coupling to the duct for producing input signals corresponding to sound in the duct prior to acoustic filtering;

an error microphone adapted for coupling to the duet for producing error signals corresponding to sound in the duct after acoustic filtering; and a controller receiving and detecting differences between the input signals and the error signals to produce the control signals, the controller transmitting the control signals to the motorized wheel to control the motorized wheels to position the movable laminate plate and the movable Helmholtz resonator.

2. The multiple Helmholtz resonators according to claim 1, further comprising a C-channel physically attached to the immovable Helmholtz resonator and receiving the movable laminate plate.

3. The multiple Helmholtz resonators according to claim 1, further comprising an additional motorized wheel in contract with the movable laminate plate and moving in response to the control signals.

4. The multiple Helmholtz resonators according to claim 1, wherein the movable Helmholtz resonator is positioned adjacent to the immovable Helmholtz resonator so that the Helmholtz resonators are acoustically coupled and the following formula describes their resonant frequencies:

$$f_{1,2} = \frac{c_o}{2\sqrt{2\pi}} \sqrt{\left(\frac{A_{C1}}{l'_{C1}V_1} + \frac{A_{C2}}{l'_{C2}V_1} + \frac{A_{C2}}{l'_{C2}V_2}\right) \pm \sqrt{\left(\frac{A_{C1}}{l'_{C1}V_1} + \frac{A_{C2}}{l'_{C2}V_1} + \frac{A_{C2}}{l'_{C2}V_2}\right)^2 - 4\left(\frac{A_{C1}}{l'_{C1}V_1}\frac{A_{C2}}{l'_{C2}V_2}\right)}}.$$

5. The multiple Helmholtz resonators according to claim 1, wherein the movable Helmholtz resonator is positionable partially adjacent to the immovable Helmholtz resonator so that the Helmholtz resonators are partially acoustically coupled.

6. A method for using multiple Helmholtz resonators for filtering sound in a duct having a neck aperture, comprising the steps of: detecting sound prior to acoustic filtering by the multiple Helmholtz resonators with an input microphone and generating corresponding input signals; detecting sound after acoustic filtering by the multiple Helmholtz resonators with an error microphone and generating corresponding error signals; comparing the input signals and error signals with a controller, the controller generating control signals; transmitting the control signals to a motorized wheel, the motorized wheel adapted to adjustably move a movable laminate plate to position and acoustically couple a movable Helmholtz resonator and an immovable Helmholtz resonator, wherein the movable Helmholtz resonator is mounted on the movable laminate plate adjacent to a neck aperture in the movable laminate plate.

7. The method of claim 6, further comprising the step of adjusting the position of the movable Helmholtz resonator with respect to the immovable Helmholtz resonator to filter two desired resonant frequencies.

8. The method of claim 6, further comprising the step of adjusting the position of the movable Helmholtz resonator with respect to the immovable Helmholtz resonator so that the movable Helmholtz resonator is in acoustic alignment with respect to the immovable Helmholtz resonator.

9. The method of claim 6, further comprising the step of adjusting the position of the movable Helmholtz resonator with respect to the immovable Helmholtz resonator so that the movable Helmholtz resonator is in partial acoustic alignment with respect to the immovable Helmholtz resonator.

10. The method of claim 6, further comprising the step of adjusting the position of the movable Helmholtz resonator with respect to the immovable Helmholtz resonator so that the movable Helmholtz resonator is not in acoustic alignment with respect to the immovable Helmholtz resonator.

* * * * *